United States Patent [19]

Stryd

[11] Patent Number: 4,802,692

[45] Date of Patent: Feb. 7, 1989

[54] CONTINUOUS PERFORATED PAPER SHEET FOR PRINTER

[76] Inventor: Thomas N. Stryd, 7907 W. "R" Ave., Kalamazoo, Mich. 49009

[21] Appl. No.: 87,654

[22] Filed: Aug. 20, 1987

[51] Int. Cl.[4] ..... B42D 19/00

[52] U.S. Cl. ..... 281/5; 281/2; 252/12 R; 428/43

[58] Field of Search ..... 281/2, 5, 38, 29, 15 R, 281/79, 4; 282/11.5 A, 12 R, 12 A; 428/43

[56] References Cited

U.S. PATENT DOCUMENTS

| | | | |
|---|---|---|---|
| 4,477,103 | 10/1984 | Bertolazzi | 252/11.5 A X |
| 4,508,365 | 4/1985 | Howes | 281/2 |
| 4,560,600 | 12/1985 | Yellin et al. | 210/360 X |
| 4,705,297 | 11/1987 | Wakeman | 281/2 |

FOREIGN PATENT DOCUMENTS

| | | | |
|---|---|---|---|
| 2383023 | 10/1978 | France | 282/11.5 A |
| 2184062 | 6/1987 | United Kingdom | 282/12 R |

*Primary Examiner*—Paul A. Bell

*Attorney, Agent, or Firm*—Flynn, Thiel, Boutell & Tanis

[57] ABSTRACT

An elongate sheet of paper adapted for use in a printer includes spaced, parallel edges provided on opposite sides thereof, a respective row of feed holes therethrough adjacent each edge, and two lengthwise perforation lines which are each located adjacent a respective row of feed holes. A plurality of pairs of transverse perforation lines extend between the edges substantially perpendicular thereto, the transverse perforation lines being spaced from each other in a direction lengthwise of the sheet. Extending between each pair of transverse perforation lines perpendicular thereto and at a location between the lengthwise perforation lines is a respective further perforation line. Provided between each pair of transverse perforation lines on each side of the further perforation line are two auxiliary holes which are spaced from each other in the lengthwise direction of the sheet.

16 Claims, 2 Drawing Sheets

CONTINUOUS PERFORATED PAPER SHEET FOR PRINTER

FIELD OF THE INVENTION

This invention relates to an elongate paper sheet adapted for use in a printing mechanism and, more particularly, to such an elongate paper sheet which is designed to minimize the portion thereof which is wasted in certain applications.

BACKGROUND OF THE INVENTION

In many applications, a computer-driven printer generates only one or two pages of printed information in response to each task which produces printed output. However, and as discussed in more detail below, the paper feed mechanisms of most conventional printers which use elongate sheets of interconnected sections or pages make it necessary to eject from the printer an additional page which is blank in order to remove from the printer the final page which has printing thereon. The additional blank page is usually thrown away. Consequently, in applications of this type, the portion of an elongate sheet which is essentially wasted can be as high as 30% to 50% of the sheet. Obviously, waste at this level represents a significant expense, and a reduction of the amount of waste will result in a significant savings. Further, such a reduction presents environmental advantages, since it reduces the number of trees which must be destroyed to make paper and since it also reduces the amount of waste paper which must be incinerated or dumped in landfills.

Accordingly, it is an object of the invention to provide an elongate sheet of paper which is suitable for use in a conventional printing device and which is designed to significantly reduce the amount of paper which is simply thrown away in applications of the type described above.

SUMMARY OF THE INVENTION

According to one form of the present invention, an elongate paper sheet has spaced, parallel edges located on opposite sides thereof, and has a plurality of pairs of transverse perforation lines extending between the edges substantially perpendicular thereto, the distance between adjacent transverse lines of two different pairs being 11 inches, and the distance between the transverse lines of each pair being substantially less than 11 inches.

According to a different form of the invention, an elongate paper sheet has spaced, parallel edges provided on opposite sides thereof, and a plurality of feed holes therethrough which are arranged in two spaced rows located adjacent the respective edges. A plurality of pairs of transverse perforation lines extend between the edges of the sheet substantially perpendicular thereto, the transverse perforation lines being spaced from each other in a direction lengthwise of the sheet. Extending between each pair of transverse perforation lines substantially perpendicular thereto and at a location between the rows of feed holes is a further perforation line. Between each pair of transverse perforation lines are two auxiliary holes which are located on opposite sides of the further perforation line.

BRIEF DESCRIPTION OF THE DRAWINGS

A preferred embodiment of the invention is described in detail hereinafter with reference to the drawings, in which.

DETAILED DESCRIPTION

Figure 1:
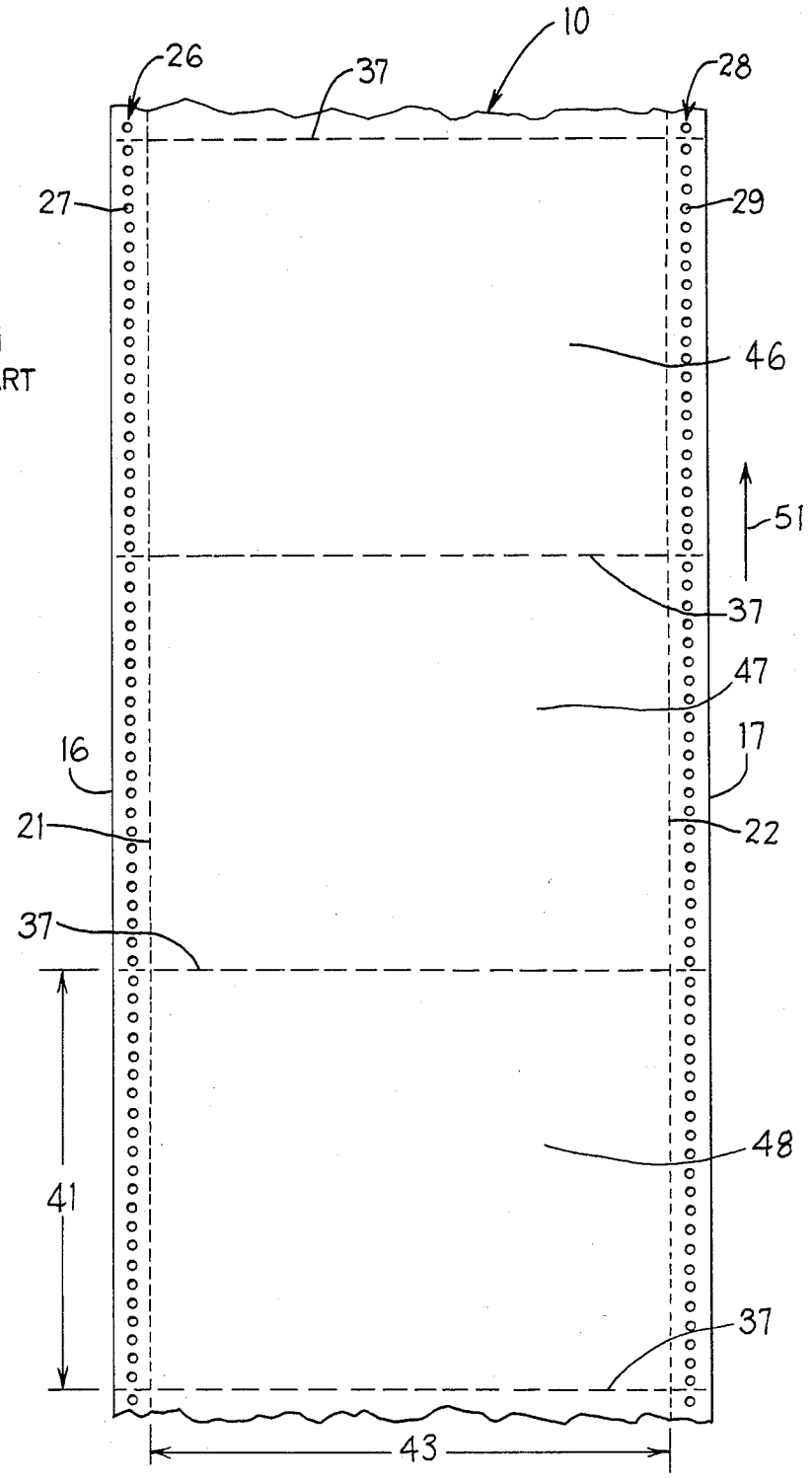
FIG. 1 PRIOR ART
FIG. 1 is a view of a conventional continuous perforated paper sheet adapted for use in a printer.

FIG. 1 shows a conventional elongate paper sheet 10 which is adapted for use in a printer for a computer. It has parallel edges 16 and 17 extending lengthwise thereof on opposite sides thereof. Two spaced perforation lines 21 and 22 are provided in the sheet 10 extending lengthwise thereof, each extending parallel to and being spaced a small distance inwardly from a respective one of the edges 16 and 17. Each perforation line consists of a series of spaced perforations which permit easy separation of the portions of the paper sheet on opposite sides of the line, in particular by tearing the sheet along the line.

A row 26 of feed holes 27 is provided in the sheet 10 intermediate the edge 16 and the perforation line 21, and a similar row 28 of feed holes 29 is provided between the edge 17 and perforation line 22. The sheet 10 has a plurality of transverse perforation lines 37 which extend between the edges 16 and 17 substantially perpendicular to the lengthwise perforation lines 21 and 22. Adjacent transverse perforation lines 37 are spaced from each other by a distance 41, which is 11 inches. A distance 43 between the lengthwise perforation lines 21 and 22 is approximately 14 inches. The paper sheet 10 thus includes several sections or pages 46, 47 and 48 which are each bounded by the lengthwise perforation lines 21 and 22 and a respective pair of adjacent transverse perforation lines 37, and which each thus have a size of 11 inches by about 14 inches.

In another common configuration in which the distance 41 is also 11 inches, the distance between the edges 16 and 17 is about 9½ inches, and the distance 43 is about 8½ inches. Also, where the distance 41 is 11 inches, and where a friction feed mechanism is used, the rows 26 and 28 of feed holes and/or the lengthwise perforation lines 21 and 22 can be omitted, the distance between the edges 16 and 17 being about 8½ inches or about 14⅞ inches.

When the conventional paper sheet 10 is being used, the conventional paper feed mechanism of a conventional printer cooperates with the feed holes 27 and 29 in order to effect lengthwise movement of the paper sheet 10, for example in the direction indicated by the arrow 51. When, for example, the printer has finished printing a page of information on the section 46 of the sheet 10, the print head of the printer will be moved so as to be aligned with the top of the section 47 in preparation to print thereon additional information (if any). When the information printed on the section 46 is the last information which is to be printed, there is usually a desire on the part of the computer operator to remove the sheet 46 from the printer by separating the sheet 46 from the sheet 47 along the transverse perforation line 37 therebetween. However, when the top of the section 47 is aligned with the print head, the feed mechanism of the printer will usually be engaging several of the feed holes 27 on each side of the line 37 between the sections 46 and 47, and several of the feed holes 29 on each side of such line 37. Alternatively, the feed mechanism may be basically engaging only the feed holes 27 and 29 located just above such line 37.

In either case, in order to separate the sections 46 and 47, the sheet 10 must be advanced in the direction 51 a sufficient distance so that the feed mechanism does not interfere with separation of the sections 46 and 47. Some conventional printers use friction feed mechanisms which do not require the feed holes, but which present equivalent problems with respect to removal of paper. Since the feed mechanisms of most printers are capable of moving the paper in only a single direction, it is not possible after detachment of the section 46 to move the paper sheet 10 in a direction opposite the arrow 51 so that the top of section 47 again becomes aligned with the print head. Instead, the sheet 10 is commonly advanced even further in the direction 51 until the top of the next successive section 48 is aligned with the print head. Consequently, nothing at all is printed on the section 47. The section 47 is thus essentially wasted, and in due course it is typically torn off and thrown away. In applications where tasks each typically print only one or two sections or pages of information, this can result in 30% to 50% of the sections of the paper sheet 10 being blank and thrown away, which is an obvious waste.

Figure 2:
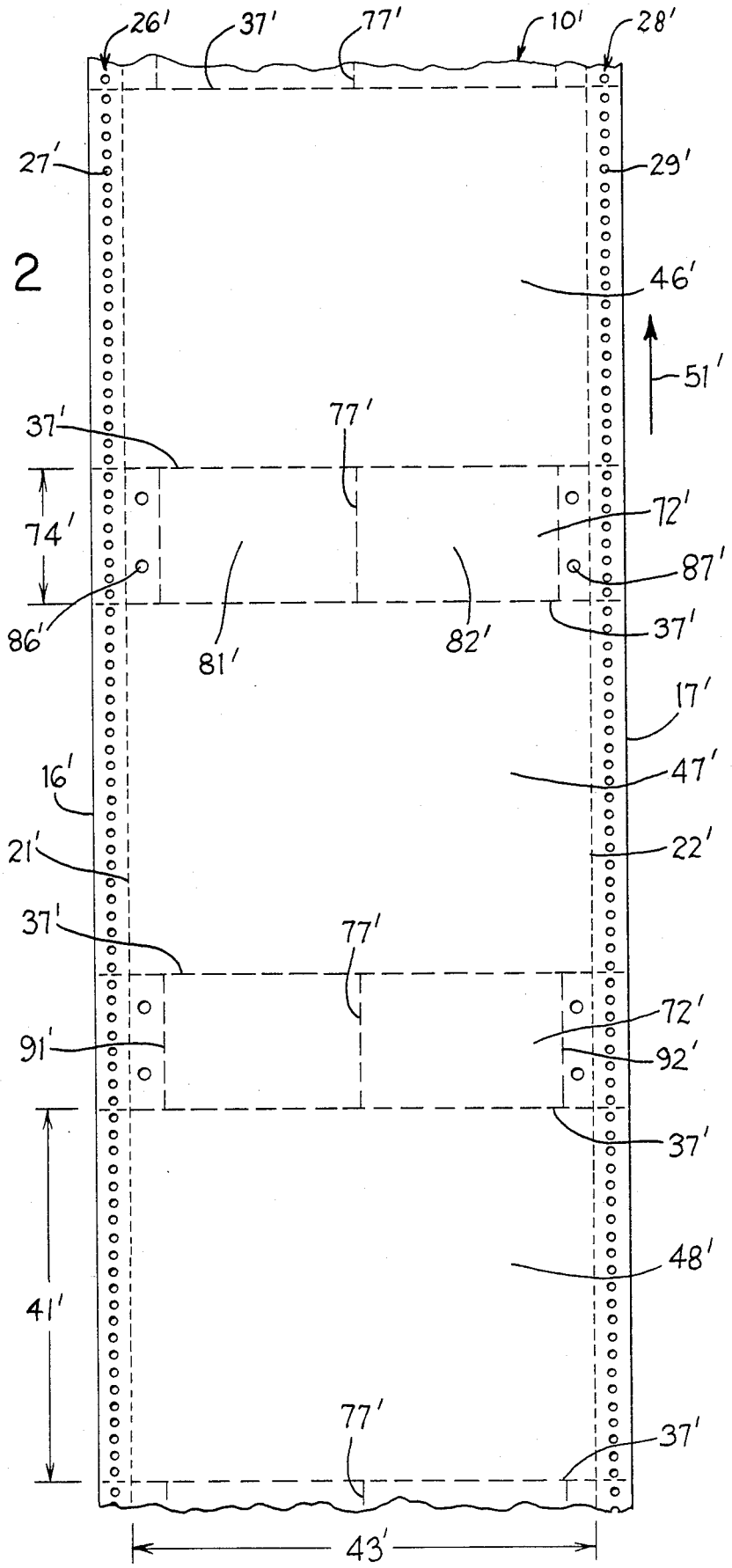
FIG. 2 is a view of a continuous perforated paper sheet which embodies the invention and is adapted for use in a printer.

Turning now to the present invention, FIG. 2 shows a paper sheet 10′ which embodies the present invention and which substantially reduces the amount of paper wasted in applications of the type just described. For convenience, equivalent structural features in FIGS. 1 and 2 are designated with similar reference numerals and, to avoid redundancy, are not described again in detail here.

In essence, an additional section 72′ is provided between the sections 46′ and 47′, a similar additional section 72′ is provided between the sections 47′ and 48′, and so forth. The additional sections 72′ are each provided between a pair of the transverse perforation lines 37′, the distance 74′ between each such pair of transverse perforation lines being 4 inches in the preferred embodiment. Extending between each such pair of transverse perforation lines 37′ perpendicular thereto and intermediate the lengthwise perforation lines 21′ and 22′ is a divider perforation line 77′ which effectively divides that additional section 72′ into two equal subsections 81′ and 82′. Each section 72′ has two auxiliary holes 86′ which are spaced from each other in the lengthwise direction of the sheet 10′ and which are provided adjacent the lengthwise perforation line 21′ on the opposite side thereof from the feed holes 27′. Each section 72′ also has provided therethrough two auxiliary holes 87′ which are spaced from each other in the lengthwise direction of the sheet 10′ and which are provided adjacent the lengthwise perforation line 22′ on the opposite side thereof from the feed holes 29′. Optionally, two additional perforation lines 91′ and 92′ can be provided across each section 72′ respectively adjacent the holes 86′ and the holes 87′.

In use, when a printer has finished printing information on the section 46′, the sheet is advanced in the direction of the arrow 51′ until the top of the section 47′ is aligned with the print head. The paper feed mechanism will thus be engaging the feed holes 27′ and 29′ near the upper end of the section 47′ and near the lower end of the section 72′, but will not be engaging the feed holes located adjacent the section 46′. Alternatively the feed mechanism may be basically engaging only the feed holes 27′ and 29′ along the edges of the section 72′. In either case, the section 46′ can be separated from the section 72′ without any need to further advance the paper sheet 10′.

As described above in association with the conventional paper sheet 10 shown in FIG. 1, the entire section 47 was left blank and was thus subject to being thrown away, thereby resulting in a significant waste of paper. In contrast, in the inventive paper sheet 10′ shown in FIG. 2, the significantly smaller section 72′ is left blank, thereby significantly reducing the amount of paper which, in the event the section 72′ is thrown away, is completely wasted. However, according to a further feature of the invention, it is possible to avoid simply throwing away and thus totally wasting the blank sections 72′.

More specifically, after the blank sections 72′ have been removed from the printer and have been separated from adjacent sections, the edge strips having the feed holes 27′ and 29′ therein are removed by effecting a separation along each of the lengthwise perforation lines 21′ and 22′. Then, the subsections 81′ and 82′ of each section 72′ are separated from each other along the divider perforation line 77′. Thereafter, a plurality of the subsections 81′ and 82′ are stacked so that the pairs of auxiliary holes 86′ and 87′ therein are aligned, and the resulting stack is bound together by a conventional binding mechanism having portions which extend through the aligned auxiliary holes. The binding mechanism is itself conventional and not a part of the present invention, and is therefore not illustrated in the drawings or described in detail here. An example of a suitable binding device is a clip manufactured and sold by Acco International, Inc. of Chicago, Ill. under stock number 70012. After the stack has been properly bound, it can be used as note paper for the purpose of jotting down ideas, reminders, appointments, and so forth. Consequently, when the sections 72′ are thus divided and bound and then subsequently used as note paper, the portion of the paper sheet 10′ which is thrown away without being used at all is basically limited to the edge strips having the feed holes 27′ and 29′ therein, which represent a very small portion of the overall paper sheet 10′. Each sheet in the stack can be torn from the stack by firmly tugging so that a rip occurs between each hole 86′ or 87′ and the nearest edge, or if the optional perforation lines 91′ and 92′ are present most of the sheet may be removed by effecting a separation therealong.

Although a particular preferred embodiment of the invention has been described in detail for illustrative purposes, it will be recognized that variations or modifications thereof, including rearrangement of certain structural features, are within the scope of the present invention. For example, the distance between the lines 21′ and 22′ could be about 8½ inches, the distance between the edges 16′ and 17′ being about 9½ inches. The feed holes 27′ and 29′ could be omitted. The lengthwise perforation lines 21′ and 22′ could be omitted, the distance between the edges 16′ and 17′ being about 8½ or about 14⅞ inches.

The embodiments of the invention in which an exlusive property or privilege is claimed are defined as follows:

1. An elongate paper sheet, comprising:

spaced, parallel edges located on opposite sides thereof and extending lengthwise thereof;

a plurality of pairs of transverse perforation lines each extending from one of said edges to the other thereof approximately perpendicular thereto, wherein a plurality of first sections of said paper sheet each extend between adjacent said transverse lines of respective said pairs and each have a dimension in a direction lengthwise of said sheet which is substantially greater than the dimension in said direction of each of a plurality of second sections of said sheet which each extend between the transverse lines of a respective said pair; and a plurality of divider perforation lines which each extend between and terminate at the transverse perforation lines of a respective said pair, each said first section of said sheet being free of said divider perforation lines.

2. The elongate paper sheet of claim 1, wherein each said divider perforation line is located substantially intermediate said edges.

3. The elongate paper sheet of claim 2, including between the transverse perforation lines of each said pair two further perforation lines which each extend between and terminate at such transverse perforation lines and which are disposed on opposite sides of the divider perforation line located between such transverse perforation lines, each said first section of said sheet being free of said further perforation lines.

4. The elongate paper sheet of claim 3, including between the transverse perforation lines of each said pair two pairs of auxiliary holes, the auxiliary holes of each said pair being spaced in a direction lengthwise of said paper sheet and being located adjacent a respective said further perforation line.

5. The elongate paper sheet of claim 1, including a plurality of feed holes which are arranged in two spaced, parallel rows, each said row of feed holes extending lengthwise of said sheet the entire length thereof adjacent a respective said edge thereof, and including two lengthwise perforation lines located between said rows of feed holes and extending lengthwise of said sheet the entire length thereof, each said lengthwise perforation line being located adjacent a respective said row of feed holes, and each said divider perforation line being located between said lengthwise perforation lines.

6. The elongate paper sheet of claim 5, wherein said divider perforation line is located substantially intermediate said edges of said sheet.

7. The elongate paper sheet of claim 5, including between the transverse perforation lines of each said pair and between said lengthwise perforation lines two further perforation lines which are disposed on opposite sides of the divider perforation line located between the transverse perforation lines of such pair and which extend between and terminate at the transverse perforation lines of such pair, said first sections of said sheet being free of said further perforation lines.

8. The elongate paper sheet of claim 7, wherein said divider perforation line is substantially intermediate said edges of said sheet, and including between the transverse perforation lines of each said pair and between said lengthwise perforation lines two pairs of auxiliary holes disposed on respective side of said divider perforation line.

9. The elongate paper sheet of claim 8, wherein said auxiliary holes of each said pair are spaced in a direction lengthwise of said sheet and are located adjacent a respective said lengthwise perforation line, and wherein each said further perforation line is located adjacent a respective said pair of auxiliary holes, each said first section of said sheet being free of perforation lines and holes in the region thereof between said lengthwise perforation lines.

10. An elongate sheet of paper which comprises:

spaced, parallel edges provided on opposite sides thereof and extending lengthwise thereof;

a plurality of feed holes therethrough which are arranged in two spaced and parallel rows, each said row extending lengthwise of said sheet adjacent a respective said edge thereof;

a plurality of pairs of transverse perforation lines which each extend between said edges substantially perpendicular thereto, said transverse perforation lines of each said pair being spaced from each other in a direction lengthwise of said sheet and said pairs of transverse perforation lines being spaced from each other in directions lengthwise of said sheet;

a plurality of further perforation lines which each extend between said transverse perforation lines of a respective said pair substantially perpendicular thereto and at a location between said rows of feed holes; and a plurality of auxiliary holes provided between said rows of feed holes, said transverse perforation lines of each said pair having therebetween four and only four of said said auxiliary holes, two of said four holes being located on one side of said further perforation line and the other two of said four holes being located on the other side of said further perforation line.

11. The elongate paper sheet of claim 10, including two lengthwise perforation lines located between said rows of feed holes and extending lengthwise of said sheet parallel to each other, each said lengthwise perforation line being located adjacent a respective said row of said feed holes; wherein said further perforation lines are each located between said lengthwise perforation lines; and wherein said auxiliary holes are each located between said lengthwise perforation lines.

12. The elongate paper sheet of claim 11, wherein each said auxiliary hole is located adjacent a respective said lengthwise perforation line, and wherein said auxiliary holes adjacent each said lengthwise perforation line are spaced from each other in a direction lengthwise of said paper sheet.

13. The elongate paper sheet of claim 11, wherein the distance between two said transverse lines which are adjacent each other and which are from respective said pairs is 11 inches, and wherein the distance between said transverse lines of each said pair is substantially less than 11 inches.

14. The paper sheet of claim 13, wherein the distance between said lengthwise perforation lines is approximately 14 inches.

15. The paper sheet of claim 14, wherein the distance between said transverse lines of each said pair is 4 inches.

16. The paper sheet of claim 15, wherein each said further perforation line is substantially centered between said lengthwise perforation lines.

* * * * *